US005155528A

United States Patent [19]

Morishige et al.

[11] Patent Number: 5,155,528

[45] Date of Patent: Oct. 13, 1992

[54] APPARATUS FOR CONTROLLING CONCENTRATION OF TONER IN THE LIQUID TONER OF A RECORDING APPARATUS

[75] Inventors: Takayoshi Morishige; Ken-Ichiro Iida, both of Tokyo, Japan

[73] Assignee: Nippon Steel Corporation, Tokyo, Japan

[21] Appl. No.: 727,234

[22] Filed: Jul. 5, 1991

[30] Foreign Application Priority Data

Jul. 6, 1990 [JP] Japan ..... 2-179267
Jan. 25, 1991 [JP] Japan ..... 3-025311

[51] Int. Cl.[5] ..... G03G 21/00

[52] U.S. Cl. ..... 355/208; 346/153.1; 355/256

[58] Field of Search ..... 355/256, 208, 245; 118/659-661; 346/153.1, 155, 75

[56] References Cited

U.S. PATENT DOCUMENTS 3,529,546 9/1970 Kollar ..... 101/426
4,121,222 10/1978 Diebold et al. ..... 346/75
4,413,264 11/1983 Cruz-Uribe et al. ..... 346/75 X
4,525,726 6/1985 Mori ..... 346/75
4,963,927 10/1990 Ishihara ..... 355/208 X

FOREIGN PATENT DOCUMENTS 0144184 6/1987 Japan .
0174362 11/1988 Japan .

*Primary Examiner*—Richard L. Moses
*Assistant Examiner*—William J. Royer
*Attorney, Agent, or Firm*—Pollock, Vande Sande & Priddy

[57] ABSTRACT

In a recording apparatus for recording an image on the basis of image data having a large number of dot signals representing the image by using a liquid toner contained in a container and including a toner and a solvent for solving the toner, the number of dot signals included in the image data supplied to the recording apparatus is counted, a decreased amount of the solvent in the liquid toner is detected, and the toner is supplied to the container on the basis of the counted number of the dot signals and the detected decreased amount of the solvent in the liquid toner, whereby the concentration of the toner in the liquid toner is controlled to be constant.

7 Claims, 5 Drawing Sheets

APPARATUS FOR CONTROLLING CONCENTRATION OF TONER IN THE LIQUID TONER OF A RECORDING APPARATUS

BACKGROUND OF THE INVENTION

1. Field of the Invention

The present invention relates to an apparatus for controlling the concentration of a liquid toner in a recording apparatus, and more particularly to an apparatus which is adapted to control the concentration of a liquid toner to be constant.

2. Description of the Related Art

In a recording apparatus employing a liquid toner, for example, an electrostatic recording apparatus, the concentration of a toner in the liquid toner largely influences the quality of recorded images, and therefore the toner concentration is required to be constant. However, since a sensor for directly measuring the toner concentrations is expensive, it is quite rare to measure the toner concentration to automatically control the same in conventional electrostatic recording apparatus.

Generally, as recording operations are performed, toner particles included in a liquid toner used for the recording operation are gradually decreased, which results in making the toner concentration lower. When image data having a large number of dot signals representing an image to be recorded is applied to an electrostatic recording apparatus, the recording apparatus records an image formed by the toner on a recording medium in the form of a large number of dots corresponding to the dot signals. There has been therefore proposed, for example in JP-A-62-144184 and JP-A-63-174362 (UM), an apparatus which counts the number of dot signals included in the image data or measures the image length as recorded and automatically supply an amount of enriched toner liquid corresponding to the number of the counted dots or the measured image length to a liquid toner.

However, since the liquid toner generally employs a volatile solvent, the concentration of the liquid toner is influenced not only by an amount of consumed toner but also by an amount of evaporated solvent. It is therefore quite difficult to correctly adjust the concentration of the liquid toner only by counting the number of dot signals included in the image data to supply the toner in accordance with the counted number of the dot signals.

SUMMARY OF THE INVENTION

It is an object of the present invention to provide an apparatus for controlling the concentration of a liquid toner in a recording apparatus with high accuracy taking into account not only a consumed amount of toner but also a decrease of the liquid toner due to evaporation of solvent and so on.

A recording apparatus such as an electrostatic recording apparatus is typically provided with a recording head having recording electrodes which are linearly aligned in one or two rows. As a recording medium is transported relative to the recording head in a direction perpendicular to the direction in alignment of the recording electrodes, the recording head repeats recording on the recording medium line by line based on the image data applied thereto thereby recording a two-dimensional image on the recording medium. Alternatively, there is another type of recording apparatus having a recording head with a single recording electrode, wherein the recording head scans a recording medium in one direction to perform one line recording and repeats the one line recording while transporting the recording medium in a direction perpendicular to the one direction thereby recording a two-dimensional image.

In an electrostatic recording apparatus as mentioned above, an amount of decreased solvent of a liquid toner employed in the recording apparatus depends on the number of lines recorded on a recording medium by a recording head. It is therefore possible to estimate a decreased amount of the solvent in the liquid toner from the number of recorded lines. Also, since a decreased amount of the liquid toner contained in a liquid toner tank arranged in the recording apparatus mainly depends on a decreased amount of the solvent, it is also possible to estimate a decreased amount of the solvent from a decreased amount of the liquid toner in the liquid toner tank. In the present invention, the characteristics of the consumption of the liquid toner as stated above are taken into account to detect a decreased amount of the solvent, and a supply of the toner and of the solvent are controlled taking into consideration a decreased amount of the toner as well as a decreased amount of the solvent.

According to the present invention, an apparatus for controlling the concentration of a liquid toner in a recording apparatus which is adapted to record an image on the basis of image data having a large number of dot signals representing the image to be recorded by using a liquid toner made of toner and solvent for solving the toner, and contained in a container comprises first means for counting the number of dot signals included in the image data supplied to the recording apparatus, second means for detecting a decreased amount of the solvent in the liquid toner, and third means for supplying to the container the toner and the solvent on the basis of a counted value of the first means and a decreased amount of the solvent in the liquid toner detected by the second means.

In an embodiment of the present invention, the means for supplying the toner and the solvent is adapted to supply an enriched toner liquid on the basis of a combination of a counted value of the first means and a value indicating a decreased amount of the solvent in the liquid toner detected by the second means.

In another embodiment of the present invention, the means for supplying the toner and the solvent is adapted to supply to the container the toner on the basis of a counted value of the first means and the solvent on the basis of a value indicating a decreased amount of the solvent in the liquid toner detected by the second means.

A decreased amount of the solvent may be detected on the basis of a change in the amount of the liquid toner in a liquid toner container arranged in the recording apparatus. Also, in an electrostatic recording apparatus of a type which records an image on a recording medium with a toner by repeating one line recording, a decreased amount of the solvent can be detected by counting the number of lines as recorded.

DESCRIPTION OF THE PREFERRED EMBODIMENTS

Figure 1:
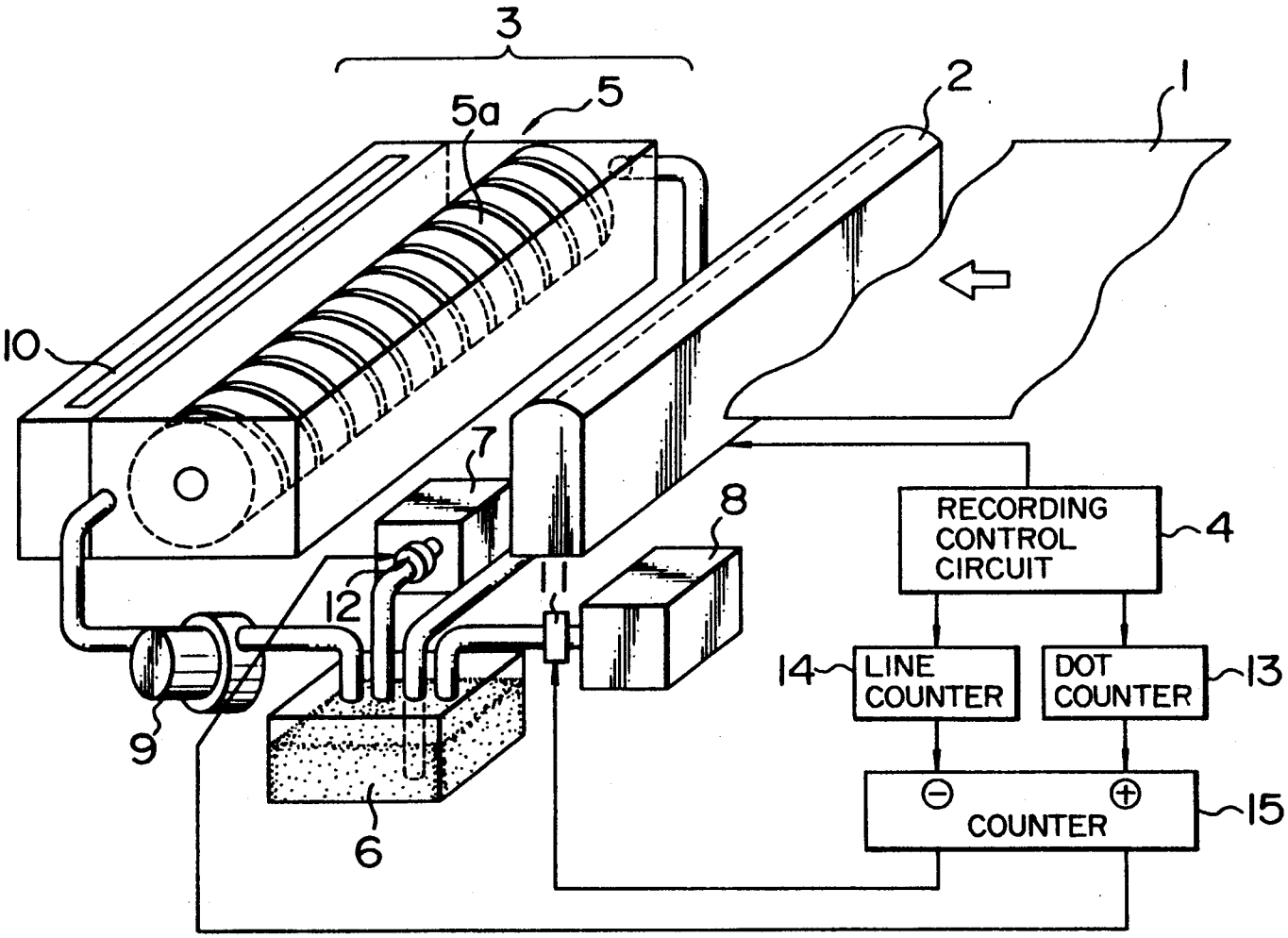
FIG. 1 is a perspective view illustrating an electrostatic recording apparatus which is provided with an apparatus for controlling the concentration of a liquid toner according to a first embodiment of the present invention.

A first embodiment of the present invention, which is implemented in an electrostatic recording apparatus, will be explained with reference to FIG. 1. Electrostatic recording paper 1 is transported by a recording paper transporting means (not shown) in the direction indicated by an arrow, that is, in the direction perpendicular to the direction of a row of multiple recording electrodes aligned on a recording head 2. The electrostatic recording apparatus is supplied with image data having a large number of dot signals representing an image to be recorded. The recording electrodes sequentially form every line portion of an electrostatic latent image on the recording paper 1 based on the supplied dot signals. The application of the image data to the recording electrodes and the transportation of the recording paper are controlled by a recording control circuit 4 having a microprocessor.

A developing unit 3 comprises a toner channel 5, a liquid toner tank 6, a pump 9, an enriched toner liquid supply unit 7 and a vacuum unit 10.

In the developing unit 3, a liquid toner including toner particles solved in a solvent is supplied from the liquid toner tank 6 to the toner channel 5 by the pump 9. In the toner channel 5, the liquid toner is applied to the surface of the electrostatic recording paper 1 by the rotation of a toner roll 5*a* on which a spiral groove is formed, and the toner is adhered to the surface of the electrostatic recording paper 1 in accordance with an electrostatic latent image. The electrostatic recording paper 1 to which the toner has been adhered is transported to the vacuum unit 10 disposed at the rear end of the toner channel 5 where excess toner is removed and then dried by a drier, not shown, to thereby complete a recording operation.

The recording control circuit 4 is connected to a dot counter 13, wherein the number of dot signals supplied to the recording electrodes is counted by the dot counter 13 which delivers one pulse to an adding terminal of a counter 15 every time 65536 ($=2^{16}$) are counted, so that a counted value m of the counter 15 is incremented one by one, as expressed by $m=m+1$.

Also, the number of lines recorded by the recording head is counted by a counter 14 which in turn delivers one pulse to a subtracting terminal of the counter 15 every time a predetermined number A, for example, $A=1500$, is counted, whereby the counted value m of the counter 15 is decremented one by one as $m=m-1$.

When this counted value m reaches a predetermined value L, for example, $L=16$, an electromagnetic valve 12 is opened for a predetermined time interval, which is experimentally determined, whereby an enriched toner liquid is supplied from the toner supply unit 7 to the toner tank 6 and the counted value m is reset to zero ($m=0$).

In the present embodiment, the hard counter or dot counter 13 for counting $2^{16}$ is employed for reducing the load of the microprocessor. Of course, direct counting of the number of dot signals will not cause any problem.

Thus, the enriched toner liquid is supplied to the liquid toner tank 6 based on the correlation between a decrease of the toner contained in the toner liquid and a decrease of the toner solvent to maintain the toner concentration constant.

Generally, it is sufficient to provide a mechanism for supplying the enriched toner liquid to the liquid toner tank 6. However, in certain apparatus, an amount of evaporated solvent is so large that the solvent must be supplied to maintain the concentration of the liquid toner constant. In this case, a solvent tank 8 and an electromagnetic valve 11 may be provided as shown in FIG. 1, such that the electromagnetic valve 11 is opened to supply a predetermined amount of the solvent to the toner tank 6 when the counted value m of the counter 15 reaches $-N'$ ($m=-N'$, $N'$ is a positive integer). Incidentally, the value of $N'$ is experimentally determined.

Figure 2:
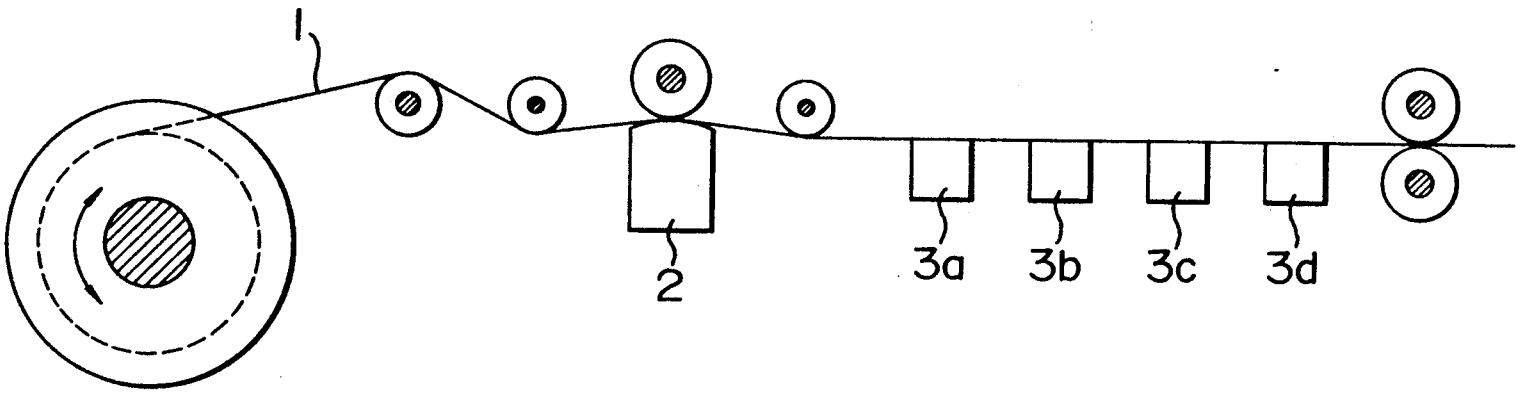
FIG. 2 is a diagram illustrating the concentration controlling apparatus of the present invention which is applied to a color electrostatic recording apparatus.

While the above description has been made for a mono-chromatic electrostatic recording apparatus, it is also possible to similarly provide a color electrostatic recording apparatus free of variation in concentrations of toners by employing a plurality of developing units 3*a*, 3*b*, 3*c*, 3*d* for respective colors as shown in FIG. 2 and counters 13, 14, 15, an enriched liquid toner supply unit 7 and so on, as shown in FIG. 1, for each of the developing units 3*a*, 3*b*, 3*c*, 3*d*.

With such a color electrostatic recording apparatus, it may be necessary to adjust a setting value L for each color.

The line counter 14 can be used commonly for all colors because the amount of evaporated solvent is not different from one color to another.

In this embodiment, the toner roll 5*a* is employed for supplying the toner to the electrostatically charged recording paper 1, so that the amount of evaporated toner liquid is larger than that in the case where a toner shoe is employed for the purpose, because the opening of the toner roll is wider than that of the toner shoe. For this reason, the present invention is particularly useful in an electrostatic recording apparatus employing the toner roll.

Figure 3:
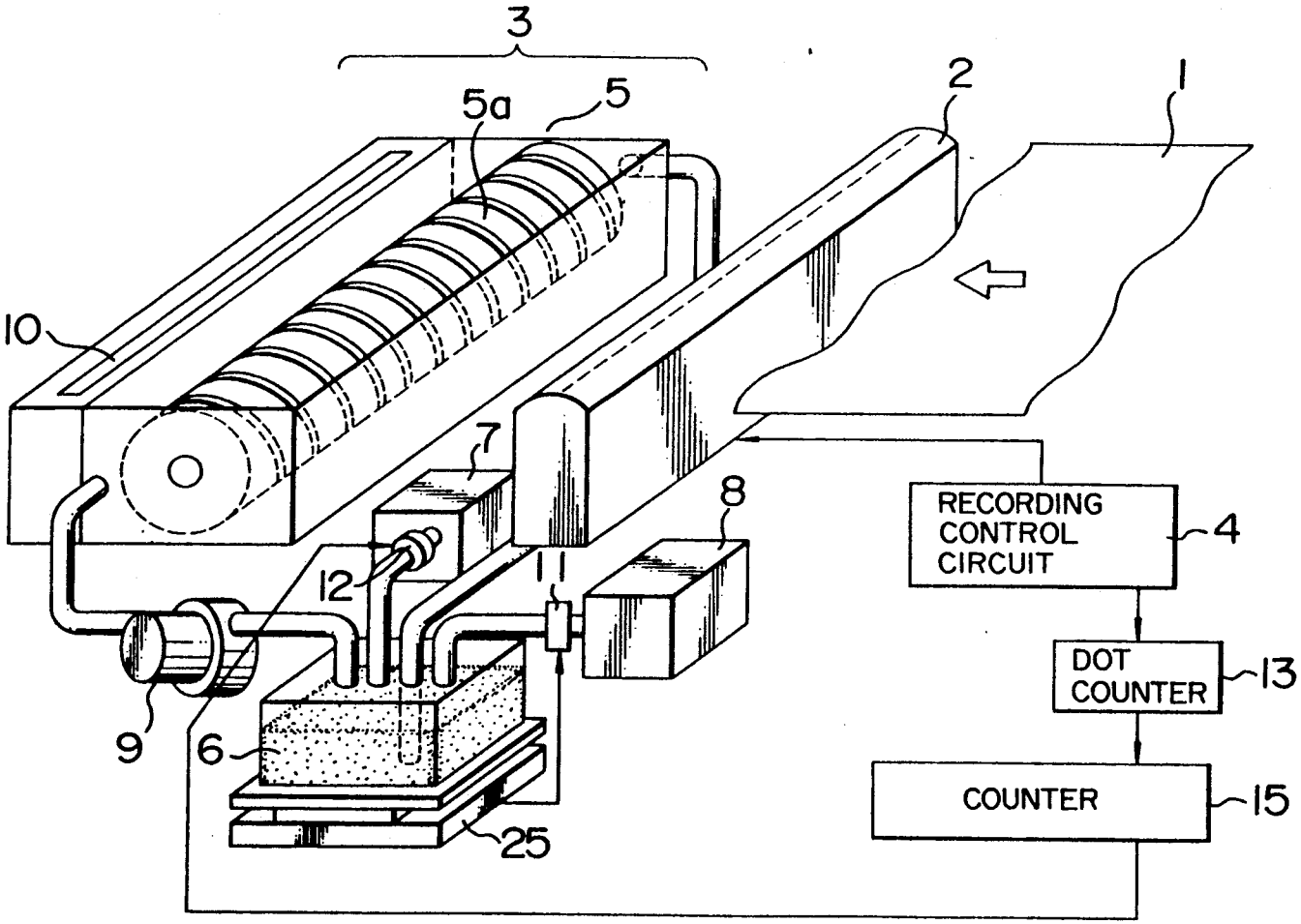
FIG. 3 is a perspective view illustrating a second embodiment of the present invention for controlling the concentration of a liquid toner on the basis of a decreased amount of a solvent of the liquid toner.

Next, a second embodiment of the present invention will be described with reference to FIG. 3. In FIG. 3, components identical or similar to those shown in FIG. 1 are designated by the same reference numerals. In the embodiment shown in FIG. 3, a counter 15 receives one pulse which is generated by a dot counter 13 every time the dot counter 13 counts 65536 and increments its count value m by one ($m=m+1$). When the count value m reaches a predetermined value L, the electromagnetic valve 12 is opened for a predetermined time interval to supply a predetermined amount of an enriched toner liquid from an enriched liquid toner supply unit 7 to a liquid toner tank 6.

The liquid toner tank 6, on the other hand, is provided with a weight meter 25. As the result of calculating a decreased amount of the toner liquid from a change in the weight of the liquid toner tank 6 including the toner liquid contained therein, if the decreased amount exceeds a predetermined value, an electromagnetic valve 11 is opened for a predetermined time interval to supply a solvent from a solvent supply unit 8 to the liquid toner tank 6.

Figure 4:
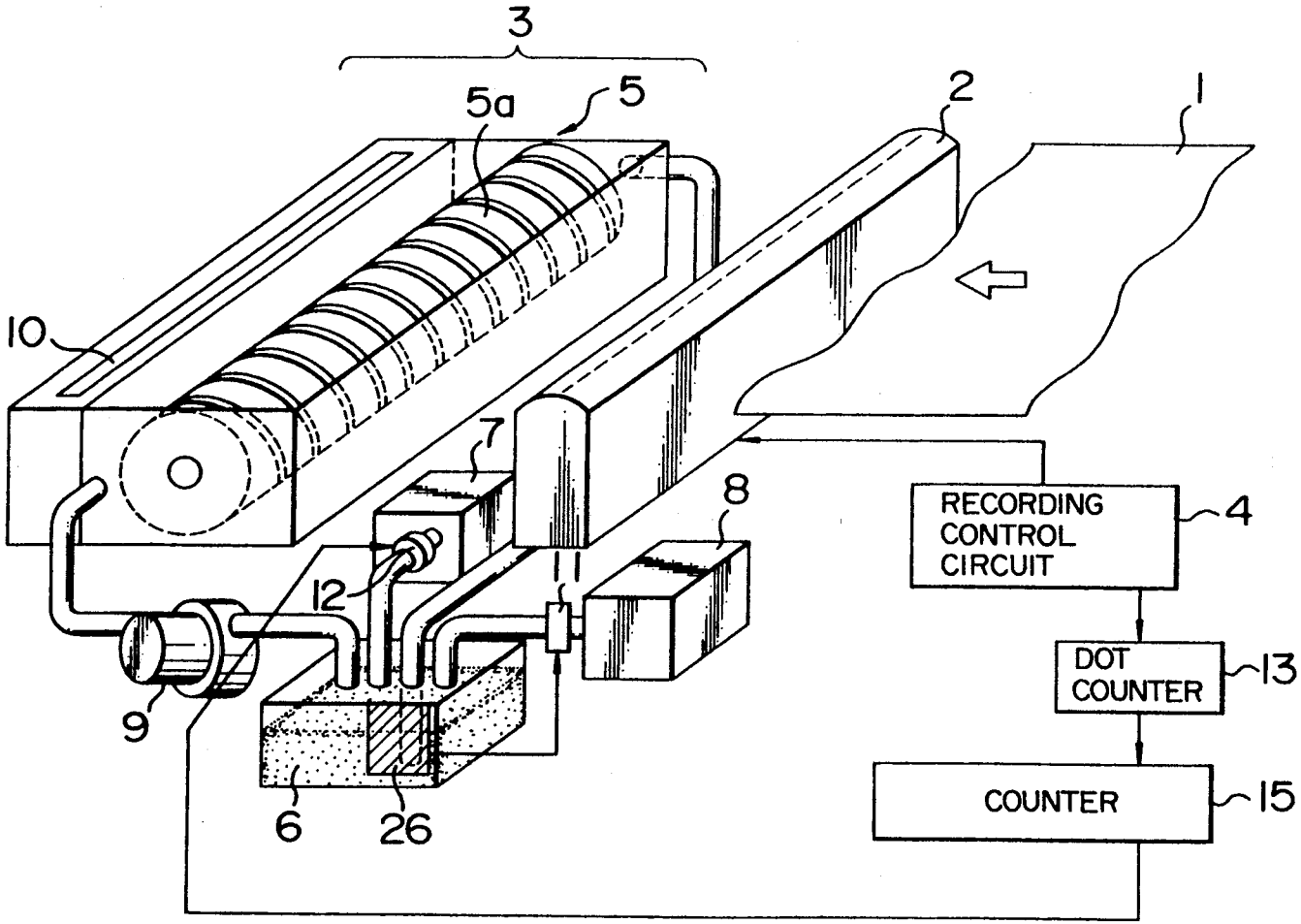
FIG. 4 is a perspective view illustrating an example of an apparatus for detecting a decreased amount of a solvent of a liquid toner.
Figure 5:
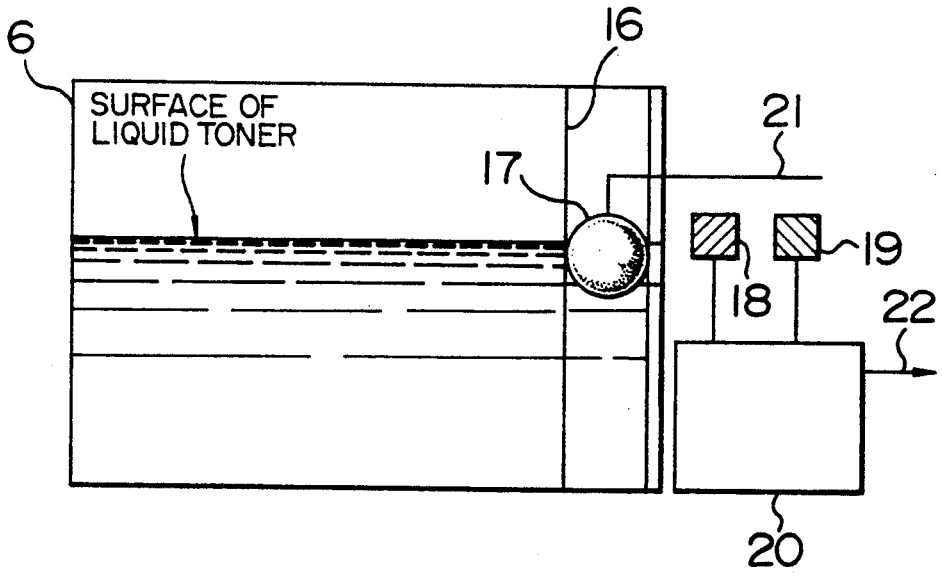
FIG. 5 is a diagram illustrating another example of an apparatus for detecting a decreased amount of a solvent of a liquid toner.

FIG. 4 illustrates a modification of the second embodiment shown in FIG. 3, wherein a toner volume measuring instrument 26 is provided in the liquid toner tank 6 in place of the weight meter 25. The toner volume measuring instrument 26 comprises, as shown in FIG. 5, a float 17 coupled to a contact arm 21 made of an electrically conductive material, electric contacts 18, 19, and a pulse generator 20 for generating a pulse signal having a predetermined time width when the contacts 18, 19 are electrically connected with each other. The float 17 vertically moves along a guide plate 16 with vertical movement of the level of the surface of the liquid toner in the liquid toner tank 6. When the surface of the liquid toner lowers to a predetermined level, the arm 21 is in contact with the contacts 18, 19 to cause an electric connection therebetween, whereby the pulse generator 20 generates a pulse signal. The electromagnetic valve 11 is opened by this pulse signal for a predetermined time interval to supply a predetermined amount of the solvent from the solvent supply unit 8 to the liquid toner tank 6.

In the second embodiment, the counter 15 counts only the pulses generated from the dot counter 13 to supply the enriched toner liquid, while the weight meter 25 or the toner volume measuring instrument 26 measures a decreased amount of the solvent to supply the solvent when the decreased amount reaches a predetermined value. This decreased amount of the solvent may be detected from the number of recorded lines as the first embodiment. In this case, the counter 15 in the circuit shown in FIG. 1 counts only the pulses outputted from the dot counter 13, and the electromagnetic valve 11 is directly opened by a pulse outputted from the line counter 14 for a predetermined time interval to supply the solvent to the liquid toner tank 6.

We claim:

1. In a recording apparatus for recording an image on a recording medium by repeating one line recording based on image data having a large number of dot signals representing the image by using a liquid toner including a toner and a solvent for solving the toner, said liquid toner being contained in a container, an apparatus for controlling concentration of the toner in the liquid toner comprising:

first means for deriving a first value related to a number of the dot signals included in said image data supplied to the recording apparatus;

second means for deriving a second value related to a number of repetitions of said one line recording; and third means for supplying additional toner into said container on the basis of said first value and includes means for determining a timing of supplying the toner to the container based on said first value with a delay determined by said second value.

2. An apparatus according to claim 1, wherein said third means includes means for deriving a third value as a predetermined function of said first value and said second value, and means for supplying additional toner into said container when said third value exceeds a predetermined value.

3. An apparatus according to claim 2, wherein said third value is a value derived by subtracting said second value from said first value.

4. An apparatus according to claim 3 further comprising means for supplying a predetermined amount of solvent to said container when said third value is negative and an absolute value thereof exceeds a predetermined value.

5. An apparatus according to claim 1, wherein said recording apparatus is an electrostatic recording apparatus.

6. An apparatus according to claim 1, wherein said third means includes means for determining a timing of supplying the toner to the container based on said first value with a delay determined by said second value.

7. In a recording apparatus for recording an image on a recording medium by repeating one line recording based on image data having a large number of dot signals representing the image by using a liquid toner including a toner and a solvent for solving the toner, said liquid toner being contained in a container, an apparatus for controlling concentration of the toner in the liquid toner based on a correlation between decrease of the toner and of the solvent in said liquid toner during a printing process, comprising:

first means for deriving a first value related to a number of the dot signals included in aid image data supplied to the recording apparatus during the printing process;

second means for deriving a second value related to a number of repetitions of said one line recording during the printing process; and third means for receiving said first and said second value and for supplying additional toner into said container on the basis of a third value determined as a correlation between said first value and said second value.

* * * * *